United States Patent [19]

Bardet

[11] 4,070,740

[45] Jan. 31, 1978

[54] CONTINUOUS PRODUCTION HOT-SETTING INSTALLATION

[75] Inventor: Gerard Bardet, Paris, France

[73] Assignee: Automatisme & Technique, Arcueil, France

[21] Appl. No.: 603,574

[22] Filed: Aug. 11, 1975

[30] Foreign Application Priority Data

Sept. 3, 1974 France ..... 74.29949

[51] Int. Cl.[2] ..... H01J 9/46

[52] U.S. Cl. ..... 29/25.19

[58] Field of Search ..... 29/25.19, 25.2; 219/10.53, 10.57, 10.79

[56] References Cited

U.S. PATENT DOCUMENTS

| | | | |
|---|---|---|---|
| 2,072,087 | 3/1937 | Dewar | 29/25.19 |
| 3,737,613 | 6/1973 | Gillock | 219/10.79 |
| 3,743,810 | 7/1973 | Bipard et al. | 219/10.57 |
| 3,849,850 | 11/1974 | Goutard | 29/25.19 |

*Primary Examiner*—Richard B. Lazarus

*Attorney, Agent, or Firm*—Seidel, Gonda & Goldhammer

[57] ABSTRACT

A processing or heat-treatment installation for articles which are suitable for continuous automatic assembly, characterized in that it comprises a high-frequency inductor in the form of a conductor having at least one sector of low curvature (large radius of curvature) in its effective part, which sector is placed alongside the path of motion of the workpiece and on a level with the surface to be heated.

6 Claims, 10 Drawing Figures

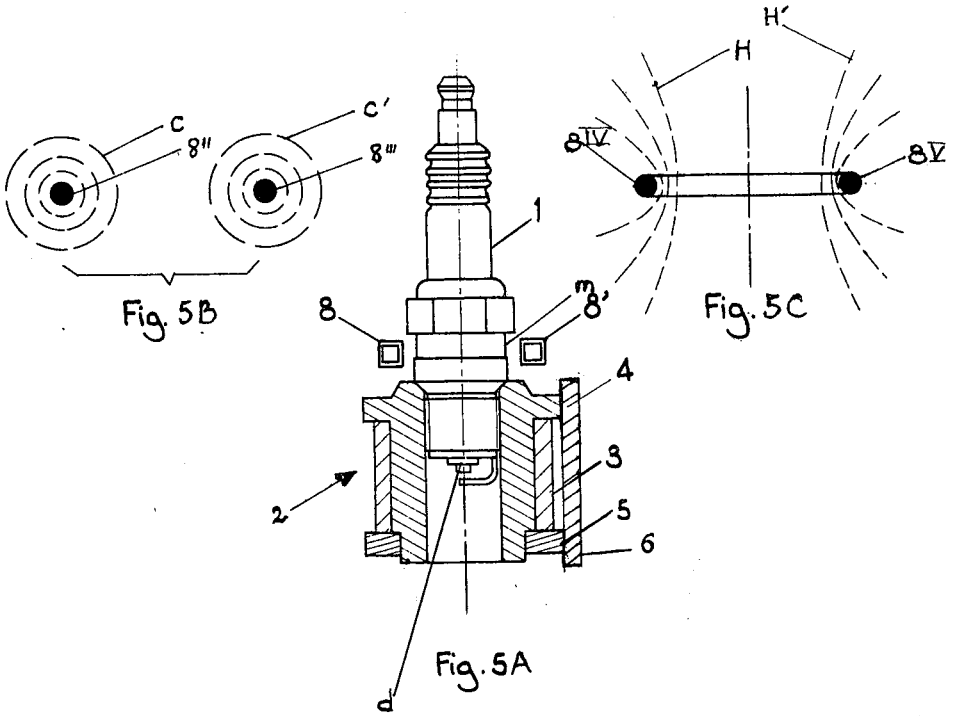
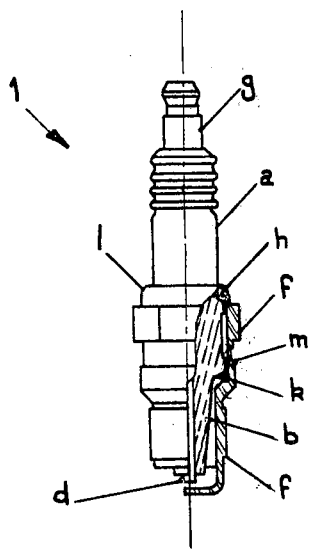
Fig. 1
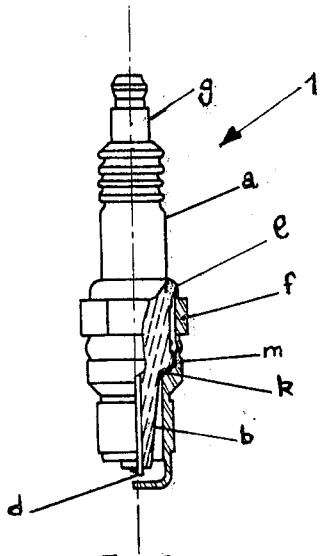
Fig. 2

CONTINUOUS PRODUCTION HOT-SETTING INSTALLATION

The present invention relates to an installation for heat-treatment or heat-processing of articles suitable for manufacture by continuous automatic assembly, for example a hot-setting installation, especially for the manufacture of sparking plugs for internal combustion engines.

In the manufacture or processing of articles, especially metal articles, it is often necessary to apply heat, within precise limits, to a restricted portion of the article in order to carry out a process.

An example of this is the known practice of reinforcing the needles of circular knitting machines by heat treatment.

The practice is also known of applying heat to the relevant portion of a sparking plug before setting it whilst it is hot.

For the purpose of illustrating the present invention most suitably, it will be described with reference to the hot-setting of sparking plugs.

A sparking plug 1 (FIG. 1) comprises basically a central element *a* comprising in turn an insulator *b* through which passes axially an electrode pin, one extremity of which is the electrode *d* whilst the other extremity is threaded to receive the terminal nut *g*.

The central element *a* is fitted into the metal plug body *f* which is threaded for insertion into the engine block. The gas-tight connection between the central element *a* and the body *f* is provided by two joints, an upper joint *h* and a lower joint *k*. After the joint *k*, the central element *a* and the joint *h* have been inserted into the body *f*, the upper lip *l* of the body *f* is cold set. This cold setting operation is simply for the purpose of assembling the components *f*, *k*, *a* and *h* and does not ensure a gas-tight joint between the central element *a* and the body *f*. This gas-tight connection is provided by the operation known as "hot-setting", the purpose of which is to apply axial pressure to the plug, thus deforming the thin portion *m* of the body *f* which has previously been heated to a dull red. On cooling, the length of the body *f* between the joints *h* and *k* is thus slightly reduced, so that the joints *h* and *k* are firmly pressed between the wall of the body *f* and the central element *a*, which produces a gas-tight joint between these two components (FIG. 2).

The hot-setting operation consists in heating the zone *m* of the body *f*, whereupon an axial downward pressure is applied to the upper extremity of the body *f*, the lower part of the body *f* being firmly secured in a support. The axial pressure is maintained until the plug *b* has cooled sufficiently.

In practice, such a hot-setting operation encounters certain difficulties. It is very important to ensure that the heating is as far as possible restricted to this part *m* of the base. Failing this, deformation would occur and other changes in other parts of the body, especially in the lower threaded portion (thread not illustrated) which is screwed into the engine block, and also in the bearing surface which provides the gas-tight joint between the sparking plug and the engine block. These defects would render the sparking plugs unserviceable.

It has indeed been found very difficult in practice to put a strict limitation on the extent of this heating. The problem has been that a method of heating must be found whose effect is very restricted and yet is sufficiently powerful to raise the temperature rapidly of this zone of the plug body *f* without this high temperature being noticeably transferred by conduction to other parts of the body. Thus, it has been proposed to pass a strong electric current axially through the plug body. The resulting heat by Joule effect naturally tends to be localised in the zone of narrowest cross-section in the plug, that is to say the zone *m*. This localization however is not as successful as might have been hoped and, in any case, the application of a strong current to the extremities of the plug body, considering that this must be carried out simultaneously with, or immediately after, a considerable mechanical stress, involves complex and expensive technological provisions.

Induction heating has also been proposed, employing a high-frequency electrical field. In the conditions obtaining where such a solution has been employed hitherto, the localization of heating has unfortunately been unsatisfactory and the results of the setting operation have not been entirely successful. Since it is necessary to apply the heat with great rapidity over a very restricted area, the quantity of heat injected into the plug body must be very limited, and, consequently, the deformation by mechanical pressure in the axial direction must be applied within a very short time, before this reduced quantity of heat can be diffused by conduction through the other parts of the plug body. In known types of installation the carrying out of this mechanical operation with a very brief time-lag and in perfect synchronisation with the heating of the plug body also involved complex and expensive equipment, especially as the mechanical pressure employed must be accurately metered.

In view of such difficulties a compromise has been adopted in known installations so that the localization of the heating of the plug body remains very approximate. This has led, not only to the unsatisfactory quality of the plugs mentioned above, but also to relatively high time factors, so that, where high production is required, it has been necessary to increase the number of stations, with the expense which this involves.

An object of the present invention is to provide a hot-setting installation which obviates or mitigates the above disadvantages, which results in a highly limited and very rapid application of heat to the article to be set, and in which the mechanical setting pressure is very powerful, is accurately metered, and is exactly synchronised with the heating operation, the combination of these advantages resulting in very low operational time-factors, leading to high production levels and ensuring a very high quality in the finished product.

Thus, the present invention relates firstly to a processing or heat-treatment installation for articles which are suitable for continuous automatic assembly, which plant is characterized in that it comprises a high-frequency inductor comprising a conductor having at least one sector of low curvature (large radius of curvature) in its active portion, which sector is placed along side the path of motion of the workpiece and on a level with the surface to be heated.

The invention further relates to a processing or heat-treatment installation for workpieces, in particular a hot-setting installation for sparking plugs, comprising processing means such as a device for pre-heating the plug body, a setting device, and also means for conveying the sparking plugs successively through the pre-heating device and then the setting device. The installation is characterised in that the unit comprising the processing means for the sparking plugs and means of conveyance thereof operate continuously. The conveyor thus carries the sparking plugs from the input of the pre-heating device as far as the output of the hot-setting device. The pre-heating device has a high-frequency inductor comprising essentially two parallel sectors located close to the path followed by the sparking plugs, which sectors are either rectilinear or are of low curvature (large radius of curvature) in order to heat very rapidly the strictly limited zone of the plug body. The setting device comprises a continuously operating turntable and a setting turret device having slide blocks for the purpose of applying the setting pressure to the plug bodies by way of a resilient means for metering the pressure applied.

Embodiments of the present invention will now be described by way of example with reference to the accompanying drawings in which:

FIG. 1 is an elevation, partly in section, of a sparking plug before it is hot-set;

FIG. 2 is a view similar to FIG. 1, but showing a sparking plug after hot-setting;

FIG. 5A shows the disposition of an inductor relative to the sparking plug;

FIG. 5B shows the disposition of the lines of force of an inductor of low curvature according to the invention;

FIG. 5C shows the disposition of the lines of force of an inductor of high curvature;

Figure 3:
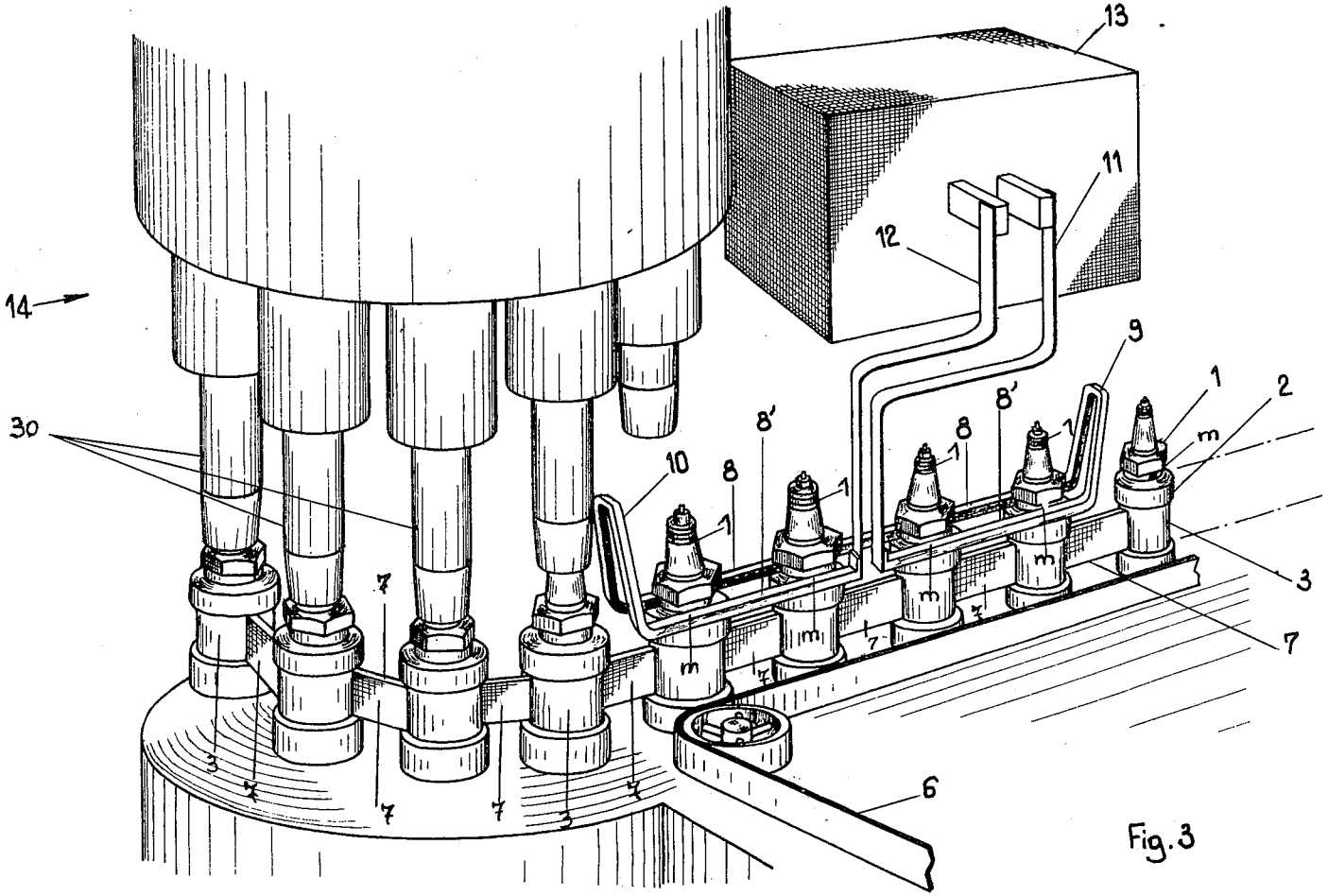
FIG. 3 is a perspective diagrammatic illustration of the essential parts of a hot-setting installation according to the invention.
Figure 4:
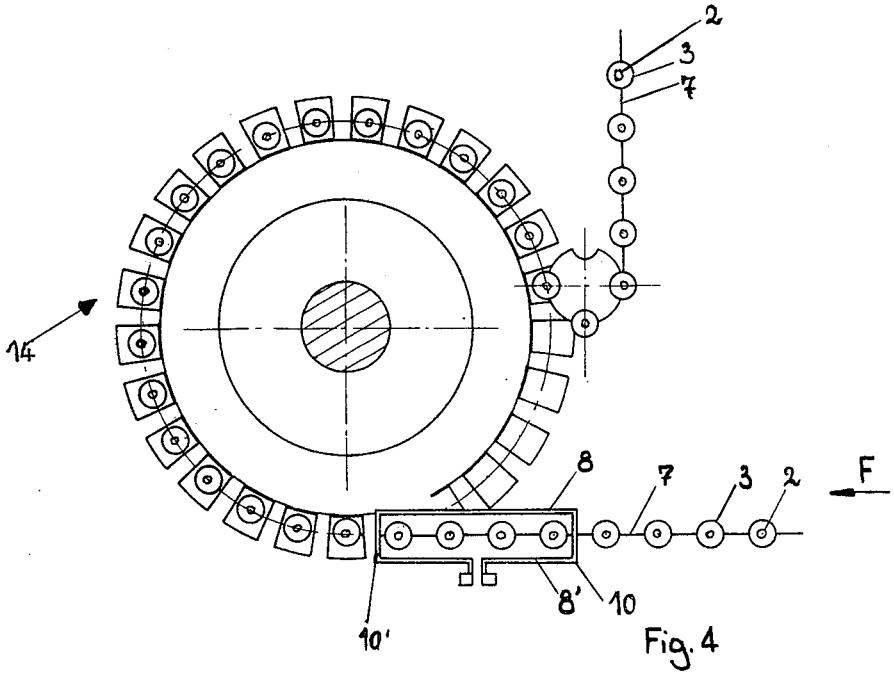
FIG. 4 is a complete diagram, showing the same essential parts of the installation, seen in plan.

Referring firstly to FIGS. 3 and 4, which show the essential parts of the hot-setting installation according to the invention, the sparking plugs 1 to be hot-set are placed in "vehicles" 2, preferably made of non-conductive material. The vehicles 2 are, in turn, mounted in rings 3 in which they can rotate upon their vertical axes. Details of this assembly can be seen in FIG. 5A. The vehicle 2 has shoulders 4 and 5 which have a dual purpose; they maintain the vehicles 2 within the rings 3, and in addition, since they have a slightly larger diameter than that of the rings 3, they are caused to rotate upon their axes by means of a belt 6 (FIGS. 3 and 5A).

The rings 3 are connected to each other by links 7 which are flexible but inextensible. The assembly of vehicles 2, rings 3 and links 7 forms a continuous chain moving continuously at a constant speed through the installation. This arrangement is known per se in moving belt installations (French Pat. No. 73 39 839).

The sparking plugs, supported upon their vehicles 2, move continuously at a constant speed following the arrow F and pass between the two sectors of a high-frequency inductor. The active portions 8, 8' of these two sectors are situated in a plane passing through the thin zone *m* of the plug bodies *f*. In this plane they are parallel to each other and the interval between them is such that they are both in close proximity to the plug bodies (see FIG. 5). In the accompanying drawings the parts 8, 8' of the inductor sectors are shown as rectilinear; it is however quite possible for them to be slightly curved in the horizontal plane, the radius of curvature being great relative to the distance between them. The importance of this feature will be apparent hereinafter.

The active portions 8, 8' of the inductor sectors are interconnected by bridges 9 and 10 and the circuit thus formed is connected by conductors 11 and 12 to the high-frequency current generator 13 which may be placed advantageously as near as possible above the inductor in order to have the leads 11 and 12 as short as possible.

The conductors 8, 8', 9, 10, 11 and 12 are preferably in the form of tubes through which a coolant passes.

As the plugs 1 pass between the sectors 8, 8' of the inductor, they are caused to rotate upon their axis at a speed which can be regulated by varying the speed of passage of the belt 6.

Immediately they emerge from the inductor, the plugs are taken over by turntable and turret assembly comprising a turntable above which is a setting turret 14, both of which operate in the conventional manner associated with automatic machine tools. On this turntable the vehicles carrying the plugs are immobilised and centered from beneath in a manner not shown in FIG. 3, but which will be described thereinafter. Overhead punches 15 then descend over the upper part of the plug bodies to exert a pressure which is exactly calculated to ensure the correct setting of the plug bodies. The manner of operation of the turntable and turret assembly will be described in detail at a later stage with reference in particular to FIGS. 6 and 7.

In FIG. 3 only the essential and original parts of the installation are shown, that is to say, those in which the preheating and the setting of the plug bodies are carried out. It is manifest that the installation is necessarily provided, at a point before the inductor, with a feed unit which mounts the plugs to be hot-set on their vehicles, and also, below the turret, a discharge point at which the plugs are removed from the vehicles. A control device may be positioned between this discharge point and the turret. All such complementary units and devices are designed and operate according to the principles of automatic assembly technology, but they have not been described in the present application as they do not form part of the present invention.

The supply or feed unit located before the installation described with reference to FIG. 3 may advantageously comprise a plurality of turrets providing for the continuous assembly of the basic components *f, k, a* and *h* of the plug, that is to say, a complete automatic assembly plant of which the present application forms only a complementary section.

Figure 6:
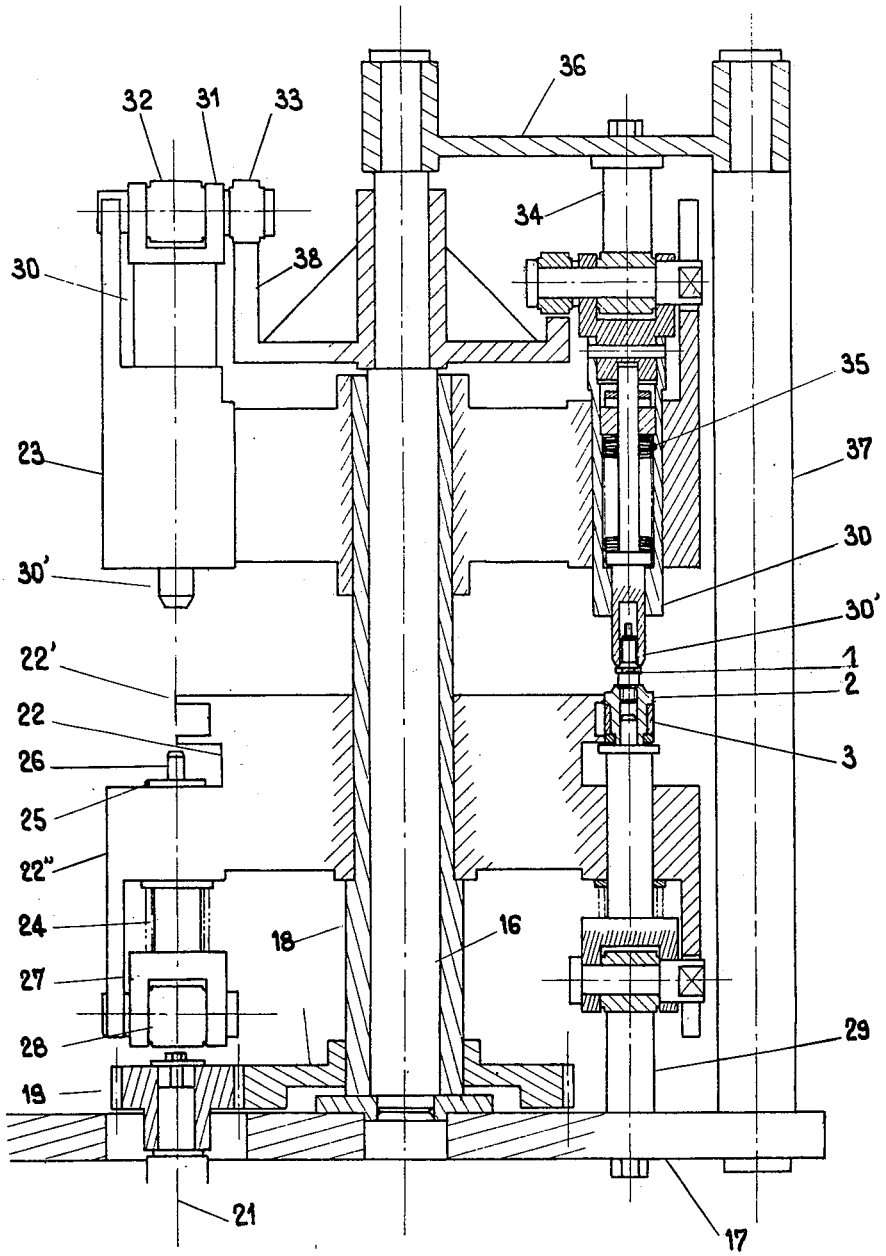
FIG. 6 is a diagrammatic view of a turntable and turret assembly of a first embodiment in which the right-hand part of the figure is in axial half-section and the left-hand part remains unsectioned.

In FIG. 6 will be seen a diagrammatic representation of a first embodiment of the turntable and turret assembly. The axis 16 is non-rotatably secured to the base 17. A hollow shaft 18 driven by way of gearing 19, 20 from a motor 21 is rotatable upon the axis 16.

A lower platform 22 (the turntable) and an upper platform 23 (the turret) are keyed to the hollow shaft 18.

The vehicles 2 with their rings 3 and 5 are inserted into chambers in the upper stage 22' of the lower platform 22. The lower stage 22'' of the lower platform 22 comprises, coaxially with each chamber of the stage 22', a slide block 24 having at its upper extremity a bearing plate 25 with centring nipple 26 and at its lower extremity a U-bracket 27 in which is mounted a control roller 28. As the platform 22 rotates, the roller 28 co-operates with a fixed ramp 29 which causes the bearing plate 25 of the slide block 24 to rise up to the level of the lower face of the vehicles 2 which is then provided with a solid under-support, whilst it is centred by the nipple 26 (see right-hand portion of FIG. 6).

The upper platform 23 carries slides 30 which are coaxial with the slides 24 of the lower platform and carry at their upper extremity a U-bearing 31 supporting a control roller 32 and a return roller 33. The control roller 32 co-operates with a fixed ramp 34 and, as the platform rotates, the slide 30 is thus caused to descend over the sparking plug 1. The lower extremity 30' of the slide 30 contains a bore into which the insulator of the plug is received so that the rim of the extremity 30' comes into contact with the upper part of the plug bodies in order to apply the necessary pressure for setting. In addition, the extremity 30' is able to slide within the body of the slide 30 which imparts its thrust to the extremity by way of a resilient means, such as for example a number of superimposed Belleville washers 35.

The reaction of the pressure applied to the plug 1 by the slide 30 through its extremity 30' is transmitted by the ramp 34 to the cross-piece 36, anchored at one end to the fixed shaft 16 and, at the other end, to a column 37. Since the pressure is applied for a certain period of time during which the turntable rotates through a certain angle, at least two columns 37 are provided at a suitable angle on the periphery of the turntable, and at the same time at least two cross-pieces 36 joining these columns to the shaft 16, so that they offer vertical support to the ramp 34. A return ramp 38 for the return rollers 33 recalls the slides 30 to the upper position when the setting operation is completed.

Figure 7:
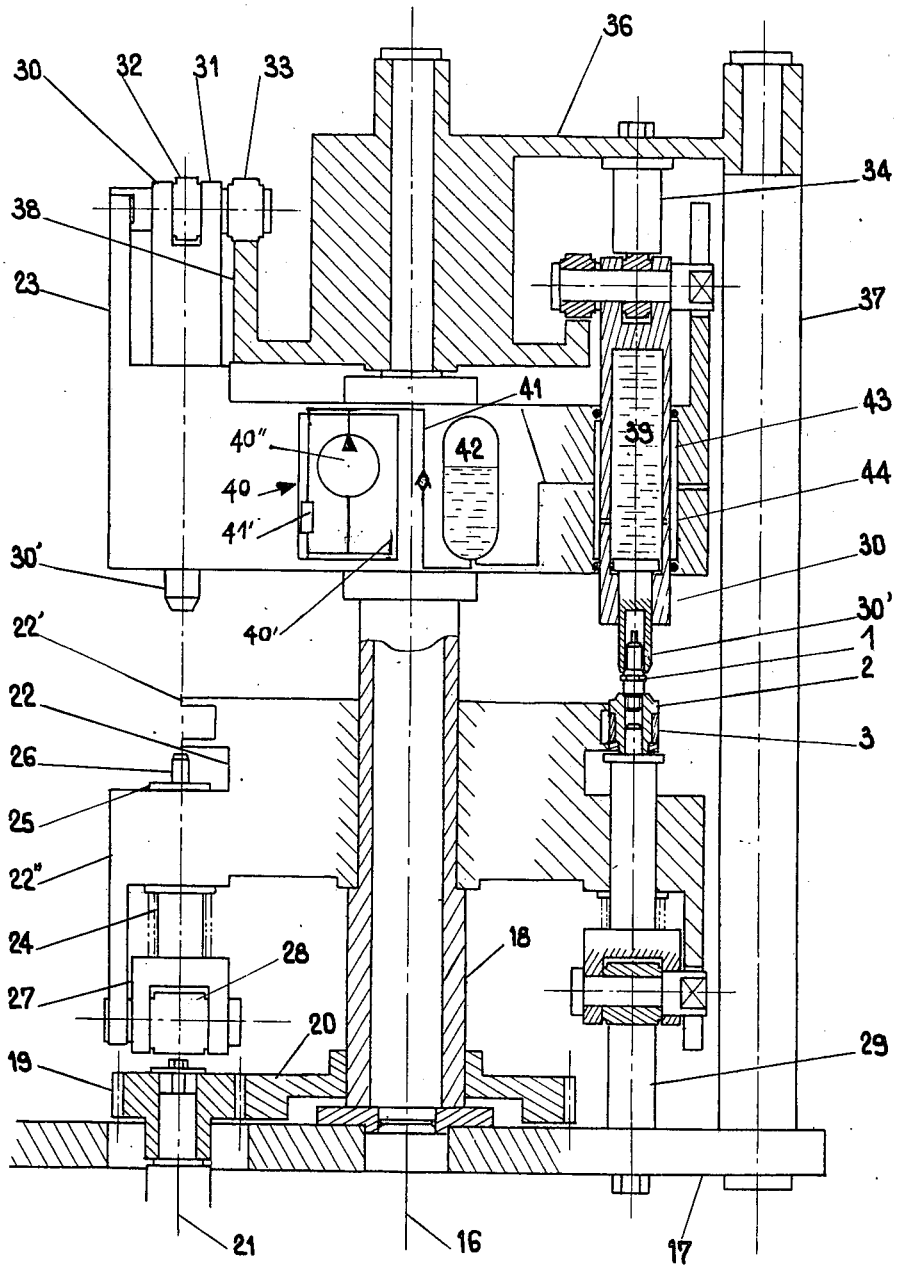
FIG. 7 is a view similar to FIG. 6, showing the turntable and turret assembly of a second embodiment of the invention.

A second method of execution of the turntable and turret assembly is shown diagrammatically in axial section in FIG. 7. This embodiment differs from that illustrated in FIG. 6 only in that the superimposed Belleville washers 35 within the slide body 30 are replaced by a pressure fluid filling the cavity 39 in the slide 30. In this case the nose 30' of the slide 30 forms the piston of a hydraulic jack. A fluid-tight joint (not illustrated) is provided between the nose 30' and the walls of the cavity 39. The pressure fluid filling the cavity 39 is piped to the cavity from a pump unit 40 shown in FIG. 7 by a simple conventional diagram and not in detail. The pump unit 40 comprises essentially an oil reservoir 40' and a pump 40'' drawing oil from the reservoir 40' and conveying it to a system of leads 41 supervised by a pressure-control valve 41', the purpose of which is to maintain a constant pressure in the leads 41. An accumulator 42, the upper part of which is filled with a gas under pressure such as nitrogen assists further in maintaining this pressure at a constant level. The pressure fluid passes through a system of leads 41 to the chamber 39 by way of a fluid-tight annular chamber 43 with ports 44. The same pump unit 40, together with the accumulator 42, supplies all cavities 39 of all the slides 30 of the turret. Consequently, the total volume thus maintained in supply remains practically constant. In effect, the volume of a given chamber 39 is governed solely by the vertical position occupied by the slide 30, which is itself governed by the position of its control roller 32 on the fixed ramp 34. The variation in these volumes following the periphery of the turntable may thus be represented by a curve corresponding to the constant profile of the ramp 34 and the area outlined by this curve, representing the total volume of the chambers 39, has thus a constant value. It follows that stabilisation of the fluid pressure in all chambers 39 is further improved since the level of the liquid in the accumulator 42 is practically static.

Thus the second embodiment of the turntable and turret assembly (FIG. 7) provides a much more accurate means of metering the setting pressure than does the first embodiment (FIG. 6). Indeed in the first case, it is impossible to regulate the different groups of Belleville washers 35 so that all offer the same resilient resistance. Moreover, their resistance varies in time.

Figure 8:
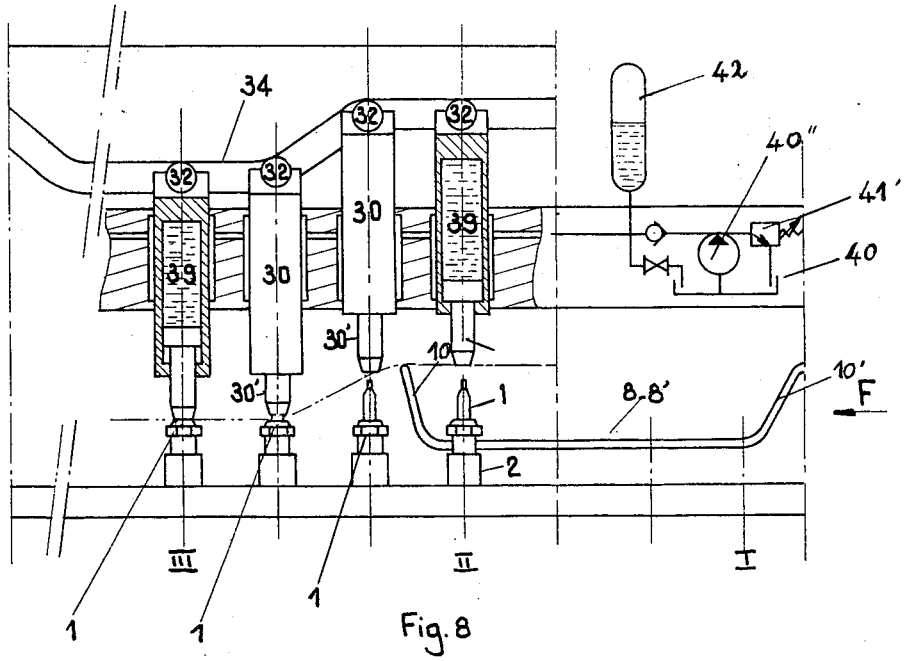
FIG. 8 is a developed diagram of the installation according to the invention.

The manner of operation of the entire hot-setting turret installation described with reference to FIGS. 3, 4, 5, 6 and 7 may be easily followed from FIG. 8, which is a developed diagram of the installation. It operates as follows:

The sparking plugs 1 conveyed in their vehicles to move in the direction of the arrow F at a continuous, constant speed corresponding to a high rate of prodction, for example 6 to 7 sparking plugs per second. At this speed the sparking plugs 1 pass between the sectors 8, 8' of the inductor from position I to position II in as short a space of time as a fraction of a second whilst at the same time pivoting on their vertical axes. The high-frequency electromagnetic field emanating from the sectors 8, 8' of the inductor have a very localized effect on the plugs 1, affecting the zone *m* of the plug bodies (FIG. 5A). This strict localization is due, in particular, to the low radius of curvature of the lines of force of the field. Indeed, as a result of the slight curvature (large radius of curvature) of the sectors 8, 8', the lines of force are comparable with those of a rectilinear conductor, that is to say, they appear in the form of concentric circles C, C' (FIG. 5B). On the other hand, if we employ, on a fixed sparking plug, an inductor of great curvature (small radius of curvature), for example in the form of a ring (FIG. 5C), the lines of force assume the form of hyperbolae of low curvature, influencing a much more extensive zone of the plug body (not illustrated) which explains why attempts carried out under these conditions have met with little success.

According to the invention, since the conductors are practically rectilinear and are located in close proximity to the plug body which is rotating on its own axis, the heating effect on the thin zone of the plug body until it reaches the requisite temperature is homogeneous, is strictly localised, and is accomplished in a fraction of a second.

For example, good results have been obtained with a production rate of 6 sparking plugs per second, employing a conductor 350 mm in length. The sectors, spaced 20 mm apart, were in the form of square tubes of 4 mm side, supplied at a frequency of 300 kc by an 80 kw generator, with a voltage of 950 Veff. and an intensity of 1450 Aeff.

As the sparking plug continues to move at constant speed from position II to position III and beyond, it is then subjected to the mechanical setting pressure. The control rollers 32, following the ramp 34, cause the slides 30 to descend. Through the intermediary of the fluid at constant pressure filling the chambers 39, the slides 30 act upon the noses 30' to bring them into contact with the upper part of the plug bodies. The setting unit shown in FIG. 7 guarantees an exact metering of the setting pressure, thus exerting an optimal pressure on the gas-tight joints *h* and *k* between the plug body and the insulator *a*. The setting pressure is maintained until the plug body has had sufficient time to cool, whereupon the ramp 34 releases the rollers 32, whilst the raising ramps 38, acting through the rollers 33, cause the slides 30 to rise.

As stated in the preamble to the description of the present application, the entire sequence of operations which has just been described, is exactly synchronised, which is a necessary prerequisite for the success of the hot-setting operation.

This synchronisation results quite simply from the fact that the endless chain consisting of the rings 3 and the links 7 moves continuously at a rigorously constant speed past a fixed inductor 8, 8' and a ramp 34 which is also fixed. One of the great advantages of continuous automatic assembly is that it offers a simple method of synchronising precisely a series of operations, each of which is of short duration. By setting in motion the operations described above, mutually linked by a system of continuous assembly, the installation according to the invention enables articles such as sparking plugs to be hot-set, the product of the entire operation possessing a quality markedly superior to that obtained in known installations, although the rate of production attained is much higher than that normally achieved heretofore.

It is manifest that the invention is not limited to the embodiments hereinbefore described and illustrated, but that, with reference to these, it is possible to envisage further embodiments and modifications without thereby departing from the scope of the invention.

I claim:

1. A spark plug processing apparatus comprising:

means for pre-heating spark plug bodies;

means for setting said spark plug bodies;

means for continuously conveying said spark plugs from the input of said pre-heating means, through said pre-heating means, then through said setting means and to the output of said setting means;

said pre-heating means including a high frequency inductor in the form of a conductor;

said conductor having two parallel sectors with no more than a low degree of curvature whereby the lines of force of the field produced in said sector are substantially concentric circles;

a portion of each spark plug body having a thinner cross-section than the remainder of said body;

said conveying means moving said portion of said spark plug bodies along the lengthwise dimension of said conductor, between said sectors and on a level with said sectors whereby said spark plug bodies are heated and the heating of each spark plug body is concentrated generally in said portion; and said setting means including a continuously operating turntable, a setting turret assembly having slide blocks for applying setting pressure to the plug bodies, and resilient means for metering the pressure applied whereby said portion of each spark plug body is deformed.

2. An apparatus according to claim 1 including means for rotating said spark plug bodies during their motion between said sectors.

3. An apparatus according to claim 1 wherein the turntable and turret assembly comprise fixed ramps concentric with the axis of the turntable, lower slides and upper slides which are displaced parallel to the axis of the turntable under the influence of said fixed ramps, said lower slides receiving, securing and centering the plug bodies while said upper slides apply the setting pressure to the plug bodies by way of a resilient means which meters this pressure.

4. An apparatus according to claim 1 wherein said resilient means for metering the setting pressure is a plurality of superimposed Belleville washers.

5. An apparatus according to claim 1 wherein said resilient means for metering the setting pressure is a hydraulic jack device to which a fluid under constant pressure is supplied.

6. An apparatus according to claim 5 wherein the upper slides have cavities for receiving said fluid, the hydraulic jack device has a pump unit comprising a fluid reservoir, a pump and pressure control valve, said unit being connected to an accumulator employing a gas under pressure and said accumulator being connected to leads which supply all the cavities of the various upper slides whereby the pressure in said leads is maintained substantially constant.

* * * * *